United States Patent [19]

Piwonka

[11] Patent Number: 4,572,132

[45] Date of Patent: Feb. 25, 1986

[54] ELECTRONIC CONTROL SYSTEM FOR A DIESEL INJECTION SYSTEM OF AN INTERNAL COMBUSTION ENGINE

[75] Inventor: Fridolin Piwonka, Tamm, Fed. Rep. of Germany

[73] Assignee: Robert Bosch GmbH, Stuttgart, Fed. Rep. of Germany

[21] Appl. No.: 413,304

[22] Filed: Aug. 31, 1982

[30] Foreign Application Priority Data

Feb. 11, 1982 [DE] Fed. Rep. of Germany ..... 3204804

[51] Int. Cl.[4] ..... F02M 39/00

[52] U.S. Cl. ..... 123/357; 123/359

[58] Field of Search ..... 123/357, 358, 359

[56] References Cited

U.S. PATENT DOCUMENTS

| | | | |
|---|---|---|---|
| 3,665,900 | 5/1972 | Schlimme | 123/357 |
| 3,695,242 | 10/1972 | Tada | 123/357 |
| 4,219,000 | 8/1980 | Locher | 123/357 |
| 4,223,654 | 9/1980 | Wessel | 123/358 |
| 4,357,920 | 11/1982 | Stumpp | 123/358 |
| 4,368,705 | 1/1983 | Stevenson | 123/357 |
| 4,372,266 | 2/1983 | Hiyama | 123/357 |

*Primary Examiner*—Carl Stuart Miller

*Attorney, Agent, or Firm*—Edwin E. Greigg

[57] ABSTRACT

For the electronic control system of a Diesel injection system a smoke pulse limitation device is proposed, so that even during dynamic operational conditions the exhaust gas clouding does not exceed unwanted high values and without requiring sensors for the direct or indirect determination of the amount of air aspirated per cylinder stroke. For this purpose there are proposed a delay element for a signal giving the desired amount of fuel as well as a real differentiator in a rpm signal processing branch. Finally, by way of a performance characteristic data storage for the smoke pulse limiter, maximally permissible fuel amount values are determined.

6 Claims, 2 Drawing Figures

ELECTRONIC CONTROL SYSTEM FOR A DIESEL INJECTION SYSTEM OF AN INTERNAL COMBUSTION ENGINE

BACKGROUND OF THE INVENTION

In German patent application No. P 28 20 807.3 an electronic control system for Diesel injection systems is known in which various parameters of an internal combustion engine are processed in the determination of the injection amount. A maximal and a minimal value selection step is placed ahead of an adjustment control in the known control system, whereby the maximal value selection step is coupled with a start signal transmitter, and the minimal value selection step processes, directly or indirectly, values such as position of the gas pedal, rpm, exhaust gas temperature and the like. One of these values also relates to the exhaust gas cloudiness, i.e., the exhaust smoke.

In the known system the maximally allowable injection amount with respect to smoke is determined, amongst others, by means of the amount of air directly measured with an air meter or indirectly with a manifold pressure sensor, which means appropriate sensors are required.

OBJECT AND SUMMARY OF THE INVENTION

The electronic control system of the present invention described hereinafter assures that the clouding of the exhaust gas does not attain too large proportions even during acting operation, i.e. during acceleration and deceleration as well as during load changes, without requiring sensors to determine the amount of air aspirated during each cylinder stroke.

In the electronic control system of the present invention a smoke performance graph, that is, characteristic curve data relating to smoke performance, serves to limit the injection amount, especially in the range of low rpm, and contains input values in regard to rpm, fuel temperature and amount of intake air.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
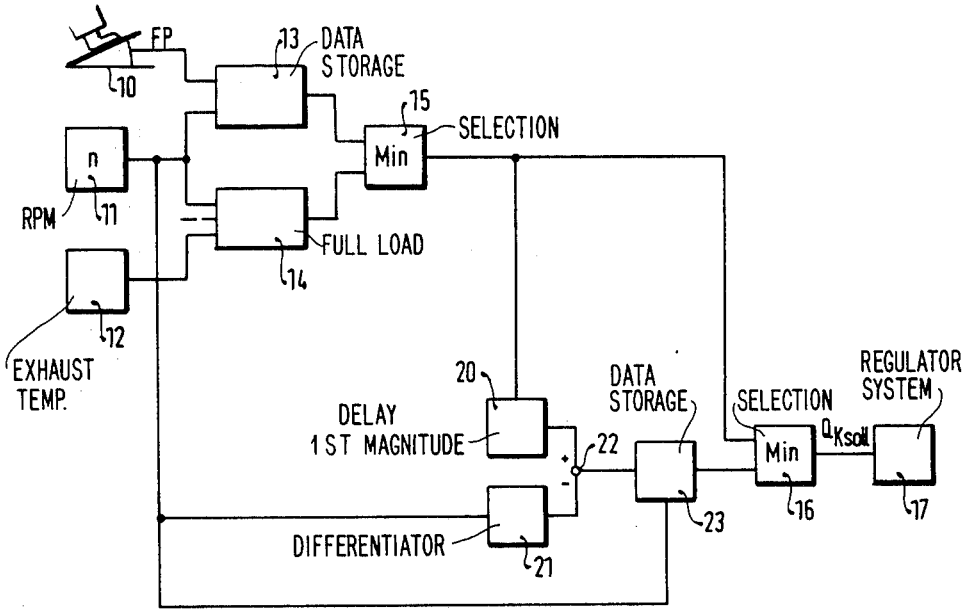
FIG. 1 is a schematic drawing of one exemplary embodiment of the present invention.

The exemplary embodiment concerns an electronic control system for a Diesel injection system of an internal combustion engine with its elements which are considered important for the scope of the invention.

A gas pedal with an associated gas pedal sensor is designated with the numeral 10; 11 designates an rpm sensor, and 12 an exhaust gas temperature sensor. 13 denotes a control performance graph or characteristic data field storage containing a variety of optimum characteristic curves related to engine operating parameters. These characteristic curves may be stored in analog or digital form, using, for example, solid state memories or function generators. Block 13 receives input signals from the gas-pedal sensor and the rpm sensor. A full-load control stage is designated as 14, which is connected with the rpm sensor 11 and the exhaust gas temperature sensor 12 and delivers (the same as the control performance graph storage 13) a signal to a minimal-value selection circuit stage 15. A second selection circuit stage 16 follows this stage 15, and the former is connected by means of further stages with a regulating system 17 for the metering member of a Diesel injection pump.

The output signal of the minimal-value selection stage 15 is supplied to a delay element of the first magnitude 20. Furthermore, a real differentiator 21 receives a signal from the rpm sensor 11. On their output sides, both blocks 20 and 21 are connected to a linking or summing point 22 which, in turn, leads to the input of a performance graph storage 23 of a smoke pulse limiter. This performance graph storage 23 receives an rpm signal directly from the rpm sensor 11 as a second input value. At the output side the storage 23 is coupled with the following minimal-value selection circuit stage 16.

Blocks 20, 21 and 23 (i.e., the analysers of dynamic processes) of FIG. 1 are different from what is known so far. While the delay element of the first magnitude 20 processes fuel volume signals, the real differentiator 21 reacts to changes in the rpm signal. The respective changes are combined at the linking point 22 and determine, in the present example, as a combined signal one of the input values of the performance graph storage 23 of the smoke pulse limiter. In this stage are stored maximally allowable values for the amount of fuel per cylinder stroke depending on rpm and dynamic range of a change, where they can be read and are again inserted into the normal signal flow of the control system in the following minimal-value selection stage 16.

In a specific internal combustion engine, a delay element of the first magnitude with a transfer function of $1/(1+TS)$ has proven reliable.

The transfer function $1/(1+s\cdot T)$ is a function of the first order, since the Laplace operator s appears only in the first power. The letter T represents the time constant of the transfer function, and it depends on the circuitry used to realize the function, for example the RC circuit mentioned below. If this transfer function $1/(1+s\cdot T)$ is transformed back into the time range, the result is the function $1-e^{-t/T}$. This is an increasing e-function which at time zero begins at zero. In connection with the Laplace transformation, this means that a four-pole circuit, for example, which is acted upon at its two input terminals by a function jumping from the zero value to a constant voltage emits a voltage at its two output terminals which in accordance with the last-named function increases from the zero value, in the form of an e-function with the time constant T, to the constant voltage mentioned. The instantaneous increase of the jump function at the input of the four-pole circuit is thus delayed by the four-pole toward a slowly increasing function. The transfer function $1/(1+s\cdot T)$ accordingly has a delaying character. Depending on the type of internal combustion engine and method of use, larger orders of magnitude may provide more useful.

The real differentiator 21 given as a present embodiment has a transfer ratio of $T1\cdot s/(1+T2\cdot S)$.

For the linking of the output signals of the two blocks 20 and 21 it has been shown to be practical to have the signal of the delay element 20 additively influence the performance graph storage 23 of the smoke pulse limiter and to assign a subtractive action to the output signal of the real differentiator 21.

This arrangement makes possible a dynamic full-load limitation with respect to permissible black smoke that is tailored to the dynamic behavior of a supercharger.

Figure 2:
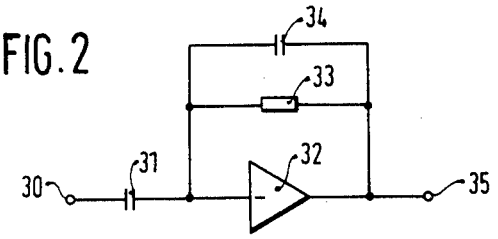
FIG. 2 shows a detail of the object of FIG. 1 in an analog version of the electronic control system, i.e., without the use of a computer.

In the course of increased introduction of computerized controls in internal combustion engines the object of FIG. 1 is not constructed from hardware but from programming steps. In case of a hardware type of solution, the real differentiator 21 is provided by a switching arrangement shown in accordance with that of FIG. 2. Following an input terminal 30 is a condenser 31 which by means of its other contact is connected with a parallel-switched arrangement of an operational amplifier 32, resistor 33 and condenser 34. On the output side this in-parallel arrangement of the three elements 32, 33, 34 is closely coupled with an output terminal 35. For a jump answer-function, this switching arrangement shown in FIG. 2 has the transfer ratio of $T1 \cdot s/(1+T2 \cdot S)$ required for the real differentiator.

In regard to the delay element of the first order 20, the hardware type of realizaton can be done with the aid of a simple RC element.

Changes in the object of FIG. 1 are possible to the extent that the input values of the performance graph storage 23 for the smoke pulse limiter can receive a different evaluation and, further, that the series-connected linking point 22 can be omitted.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. An electronic control system for a Diesel injection system of an internal combustion engine having a performance characteristic data storage means from which can be read a desired signal for fuel amount value at least rpm- and gas pedal position-dependent, at least one minimal value selection stage connected at least to the output of said data storage for the purpose of limiting the amount of fuel, the output signal of said selection stage influencing a nominal value of the amount of fuel to be injected, and further including means responsive to smoke performance for limiting smoke generation, comprising at least one delay element comprising at least one of a first and a higher order of a circuit transfer function for processing fuel volume and being acted upon by the output signal of said at least one minimal value selection stage, and an additional performance characteristic data storage means connected at least to the output signal of said at least one delay element, whereby the output signal of said additional storage means influences said nominal amount of fuel to be injected.

2. An electronic control system in accordance with claim 1, wherein said means for limiting the smoke generation comprises a real differentiator for processing the rpm signal.

3. An electronic control system in accordance with claim 2, wherein said additional performance characteristic data storage means comprises at least an input from an rpm signal.

4. A method for controlling a Diesel injection system of an internal combustion engine having a performance characteristic data storage means from which can be read a desired signal for fuel amount value at least rpm- and gas pedal position dependent for the purpose of limiting the amount of fuel, comprising the steps of, selecting a minimum value from said data storage means for affecting a nominal value of the amount of fuel to be injection, delaying by at least one of a first and a higher order of a circuit transfer function the output of said selection step for influencing the amount of fuel and thereby limit smoke generation, storing additional performance characteristic data in response to the output of said delaying step, and influencing said nominal value of the amount of fuel to be injected by the output of said storing step.

5. A method according to claim 4, wherein the step of delaying the output of said selection step includes differentiating an rpm value.

6. A method according to claim 5, wherein said step of storing additional performance characteristic data is in response to said rpm value.

* * * * *